US005287979A

United States Patent [19]

Bourgeois

[11] Patent Number: 5,287,979

[45] Date of Patent: Feb. 22, 1994

[54] OVOID CONTAINER FOR CONDIMENTS

[76] Inventor: Alain Bourgeois, Batiment A Le Petit Bosquet, Marseille 13012, France

[21] Appl. No.: 720,515

[22] PCT Filed: Jan. 12, 1990

[86] PCT No.: PCT/FR90/00024

§ 371 Date: Jul. 9, 1991

§ 102(e) Date: Jul. 9, 1991

[87] PCT Pub. No.: WO90/07896

PCT Pub. Date: Jul. 26, 1990

[30] Foreign Application Priority Data

Jan. 13, 1989 [FR] France ..... 89 00512

[51] Int. Cl.[5] ..... B65D 6/00

[52] U.S. Cl. ..... 220/4.21; 220/4.25; 220/501; 220/522; 220/523; 220/602; 220/628; 206/509; 206/511; 211/14

[58] Field of Search ..... 220/4.21, 4.25, 212, 220/DIG 13, 501, 522, 523, 602, 628; 206/509, 511; 211/14

[56] References Cited

U.S. PATENT DOCUMENTS

| | | | |
|---|---|---|---|
| 2,659,222 | 11/1953 | Meier | 220/4.25 X |
| 3,103,278 | 9/1963 | Kuzma et al. | 206/511 X |
| 3,140,007 | 7/1964 | Nettleship | 206/511 X |
| 3,902,270 | 9/1975 | Molenaar | 206/511 X |
| 4,103,774 | 8/1978 | Shingyouchi | 220/4.25 X |
| 4,124,135 | 11/1978 | Weder et al. | 220/4.25 X |
| 4,144,968 | 3/1979 | Shelton | 206/509 |
| 4,909,392 | 3/1990 | Williams et al. | 206/509 |
| 5,001,880 | 3/1991 | Smith | 220/4.25 X |

FOREIGN PATENT DOCUMENTS

| | | |
|---|---|---|
| 425448 | 2/1926 | Fed. Rep. of Germany . |
| 470330 | 1/1929 | Fed. Rep. of Germany . |
| 852894 | 10/1952 | Fed. Rep. of Germany . |
| 362723 | 7/1906 | France . |
| 1114650 | 4/1956 | France . |
| 2125815 | 9/1972 | France . |

*Primary Examiner*—Stephen P. Garbe
*Assistant Examiner*—Nova Stucker
*Attorney, Agent, or Firm*—Sandler Greenblum & Bernstein

[57] ABSTRACT

An ovoid container which has two concave halves each with an open end and a closed end. As the open ends of the two halves are connected, the closed container takes on an egg or ovoid shape. The open ends are connected by combining an annular rib of one open end with an annular groove of the other open end. The two closed ends of the concave halves are joined by a press fit of protruding stubs from one closed end into corresponding depressions of the other closed end to form an egg cup that can also be used in a container for collecting eggs.

17 Claims, 2 Drawing Sheets

OVOID CONTAINER FOR CONDIMENTS

BACKGROUND OF THE INVENTION

1. Field of the Invention

The present invention is related to an ovoid container for condiments.

2. Description of Background and Relevant Information

An ovoid container is adapted to contain condiments for egg-based dishes, or of any other food, and has the special characteristic of being transformed into an egg cup. In view of its forms and dimensions which are identical to those of a hen's egg, the invention can find its place in a container for packing eggs.

The devices that have been manufactured up until now are cup-shaped containers closed by a cap, most often integrated into the container for eggs, and necessitating a special manufacturing process for the cap. The cup can contain only one type of product which limits the possible application.

Egg-shaped containers are known in the art. German patent publication DE-C825,894 is related to a container adapted to contain and protect an egg, and can be transformed into an egg cup by assembling two sets of threads. It is provided with an external container equipped with a screwed cork and is able to contain a condiment.

French patent publication FR-A-2,125,815 is related to a system enabling the assembly, with the help of a third element, of two hollow elements having any shape, including an ovoid shape. These devices have complex assembling means that necessitate complex manufacturing processes.

SUMMARY OF THE INVENTION

The device according to the present invention eliminates these disadvantages. The device is comprised of two completely separate compartments, each closed by a separate cap, and which can contain a different product. The ovoid shape enables it to be placed in any type of container for eggs, without having to be subject to modification, and thus, facilitates the mechanization of processing on production chains. The option of transforming the ovoid container into an egg cup is an important commercial attraction.

It is comprised of a combination of two concave elements that can be assembled to form an egg-shaped container. The ovoid container may be made of a thin, possibly transparent plastic or an edible material. One of the elements forming the cover comprises an annular groove mounted with a force fit onto a corresponding annular rib of the other element to seal the container for the purpose of preserving the condiments.

Each of the condiments contained in the ovoid container can be enclosed in a bag which prevents the evaporation of aroma and the penetration of humidity.

Each of the two concave elements has a sealing cap forming an individual compartment, each of which can contain a different condiment. The sealing cap of the element forming the cover is recessed in order that the two elements can be assembled. A means is provided for enabling the bases of the two above-mentioned elements to be connected to form an egg cup, the cover acting as a base, the assembly means being able to be constituted by at least one stub being force-fitted in at least one depression or, alternatively, by the association of a circular groove that can be snapped onto a rib provided on the base of the other element.

BRIEF DESCRIPTION OF THE DRAWINGS

In the annexed drawings, that represent non-limiting examples of the embodiments of the invention.

DETAILED DESCRIPTION OF THE INVENTION

Figure 1:
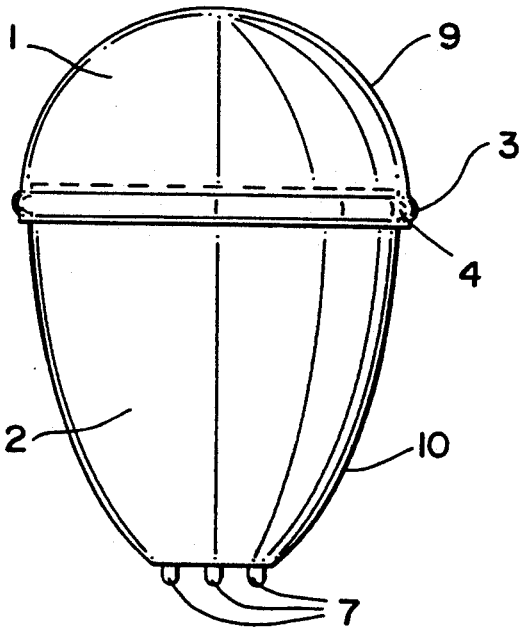
FIG. 1 is a side view of the device in its entirety in a closed position.

FIG. 1 is a side view of an ovoid container in the assembled form. A first concave element 1 is connected to a second concave element 2 by means of an internal annular groove 3 integral to the plane of the opening of the first concave element 1, and an annular rib 4 integral to the plane of the opening of the second concave element 2. On the base of the second concave element 2 are three protruding stubs 7. First concave element 1 has external surfaces 9 and second concave element 2 has external surface 10.

Figure 2:
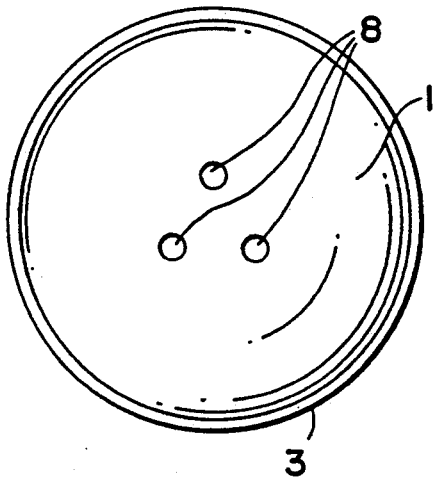
FIG. 2 is a plan view of the device.

FIG. 2 is a plan view of first concave element 1 showing internal annular groove 3 and three receptor depressions 8 on the curved end of first concave element 1.

Figure 3:
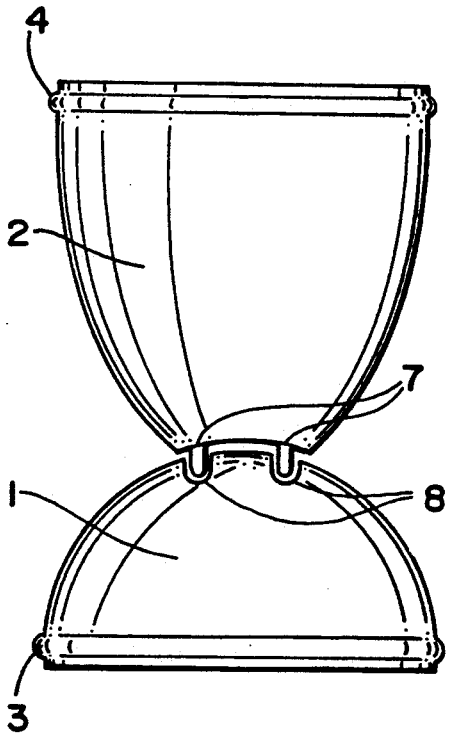
FIG. 3 is a transverse section showing the device transformed into a cup.

FIG. 3 is a transverse section showing first concave element 1 in reverse connection to second concave element 2 by means of protruding stubs 7 into receptor depressions 8 to form an egg cup. Annular groove 3 is at the plane of the opening and integral to first concave element 1, and annular rib 4 is at the plane of the opening and integral to second concave element 2.

Figure 4:
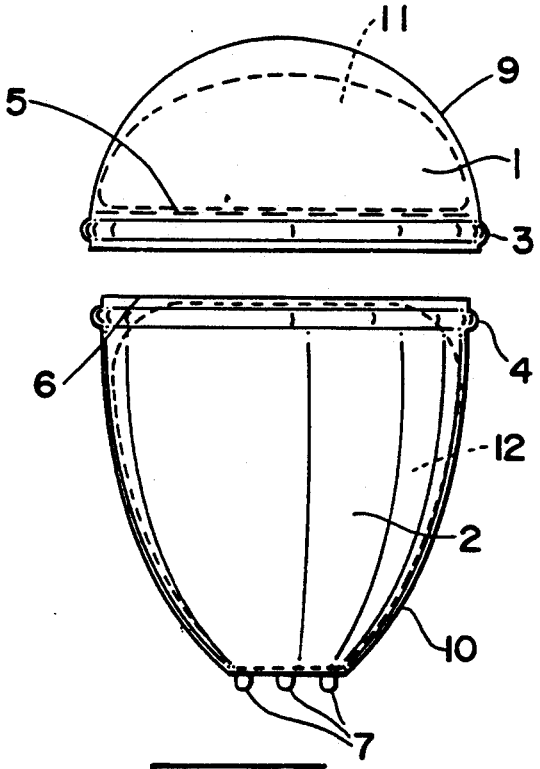
FIG. 4 is a side view which shows the two separate portions of a variation of the device with two compartments.

FIG. 4 is a side view showing first concave element 1 with a recessed cap 5 at the plane of the opening of first concave element 1 as a means to seal a first compartment formed by external surfaces 9, and the second concave element 2 with a surface cap 6 at the plane of the opening of second concave element 2 as a means to seal a second compartment formed by external surface 10.

The base of the element 2 comprises three projecting stubs 7 that can be force-fitted into three corresponding depressions 8, provided on the top of element 1, enabling, after use of the condiments, to make an egg cup, the cover acting as a base, as shown in FIG. 4.

The materials from which the ovoid container are made comprise a thin semi-rigid plastic material, which could be transparent and, alternatively, any suitable edible material. The two compartments formed by the ovoid container can be used to store different condiments separately and the different condiments can be enclosed in bags 11 and 12, schematically shown in dotted lines in first and second elements, respectively, to preserve the aroma and prevent exposure to humidity.

The external surfaces 9, 10 of the container formed by connecting first and second elements 1, 2 may be used for logos or advertising messages and images.

Figure 5:
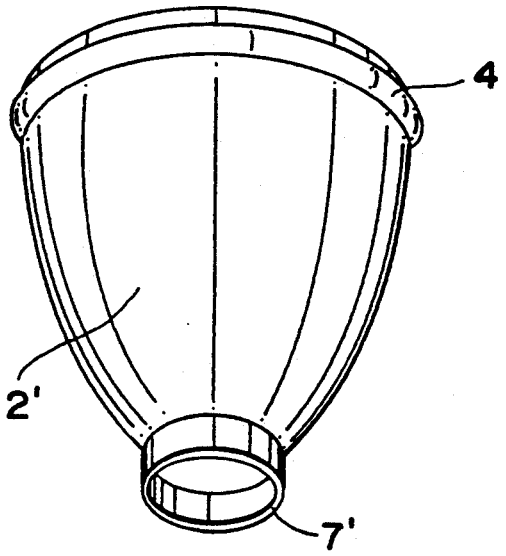
FIG. 5 illustrates a second concave element of an alternative embodiment of the device of the invention.
Figure 6:
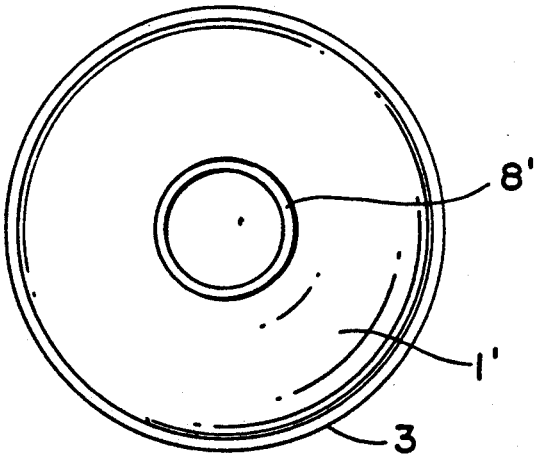
FIG. 6 illustrates a first concave element of the alternative embodiment of the device of the invention.

In an alternative embodiment, illustrated in FIGS. 5 and 6, instead of the aforementioned stubs and depressions, the first concave element 1', shown in FIG. 6, can have a circular groove 8' located at its end, whereas the second concave element 2', shown in FIG. 5, can have a corresponding rib 7' located on its base. In this manner, the cirular groove 8' can be snapped onto the rib 7' to form an egg cup, as shown in FIG. 3.

By virtue of its attractiveness to clients, the device as described is particularly well adapted for the manufacture of containers of eggs integrating condiments that enable different dishes to be prepared, such as omelets, custards, and is especially adapted for sale in larger supermarkets.

The location of the different elements allows this device to have a maximum number of uses that have not yet been available until now, by similar devices.

I claim:

1. An ovoid container comprising:

a first concave element, a second concave element, said first concave element having an open end and a closed end, said second concave element having an open end and a closed end, a first means for connecting the open end of said first concave element to the open end of said second concave element to form the ovoid container, a second means for connecting the closed end of said first concave element to the closed end of said second concave element to form an egg cup, said second means comprising means for enabling said ovoid container to be supported on said closed end of one of said first and second concave elements, and a means for sealing the first concave element to form a first compartment and a means for sealing the second concave element to form a second compartment.

2. An ovoid container according to claim 1, wherein the closed end of the first concave element is curved.

3. An ovoid container according to claim 1, wherein the closed end of the second concave element is substantially flat.

4. An ovoid container according to claim 1, wherein the first means for connecting the first concave element to the second concave element comprises an annular groove integral to the open end of the first concave element and an annular rib integral to the open end of the second concave element wherein the annular rib is receivable into the annular groove by means of a force-fit connection to form the ovoid container.

5. An ovoid container according to claim 1, wherein the second means for connecting the first concave element to the second concave element comprises a circular groove on the closed end of the first concave element and a protruding rib on the closed end of the second concave element wherein the circular groove clips onto the protruding rib to form an egg cup.

6. An ovoid container according to claim 1, wherein the means for sealing the first concave element is a cap that is recessed from the open end of the first concave element to form the first compartment.

7. An ovoid container according to claim 1, wherein the means for sealing the second concave element is a surface cap at the open end of the second concave element to form the second compartment.

8. An ovoid container according to claim 1, wherein the ovoid container is made from an edible material.

9. An ovoid container according to claim 1, wherein said means for enabling said ovoid container to be supported on said closed end of one of said first and second concave elements comprising three stubs projecting from said closed end of one of said first and second concave elements.

10. An ovoid container according to claim 1, wherein the ovoid container is made from a thin plastic material.

11. An ovoid container according to claim 10, wherein the thin plastic material is transparent.

12. An ovoid container according to claim 1, wherein the second means for connecting the first concave element to the second concave element comprises at least one receptor depression on the closed end of the first concave element and at least one stub protruding from the closed end of the second concave element wherein the stub is receivable into the depression by means of a force-fit connection to form the egg cup.

13. An ovoid container according to claim 12, wherein the number of receptor depressions is three.

14. An ovoid container according to claim 12, wherein the number of protruding stubs is three.

15. An ovoid container for condiments comprising:

two concave elements that can be assembled to form a closed egg shaped container;

an interlocking means for enabling bases of the two concave elements to be interlocked to form an egg shaped cup;

the two concave elements being made from a thin plastic material;

one of the two concave elements forming a cover having an annular groove;

the other of the two concave elements having an annular rib to force fit into the annular groove;

the two concave elements each having a sealing cap to allow containment of separate condiments;

the two concave elements when combined having the form and dimension of a farm egg for being contained within a known container for packing eggs without requiring modifications of said known container;

the two concave elements when combined, being placable into a container for packing an egg;

wherein said interlocking means comprises one of the concave elements having at least one stub located at a closed end and the other concave element having a corresponding depression at a closed end wherein the stub and depression are force fitted enabling the two concave elements to be interlocked to form an egg cup.

16. An ovoid container according to claim 15, wherein the material used for manufacturing the two concave elements is transparent.

17. An ovoid container according to claim 15, further comprising bags for containing condiments and preserving the aroma thereof, said bags being located in said two concave elements.

* * * * *